US007123859B2

(12) United States Patent
Watanabe

(10) Patent No.: US 7,123,859 B2
(45) Date of Patent: Oct. 17, 2006

(54) IMAGE FORMING APPARATUS REDUCING ADHESION OF RESIDUAL TONER TO A PHOTOSENSITIVE CONDUCTOR

(75) Inventor: Osamu Watanabe, Yokohama (JP)

(73) Assignee: Samsung Electronics Co, Ltd., Suwon-si (KR)

( * ) Notice: Subject to any disclaimer, the term of this patent is extended or adjusted under 35 U.S.C. 154(b) by 0 days.

(21) Appl. No.: 11/002,104

(22) Filed: Dec. 3, 2004

(65) Prior Publication Data

US 2005/0141918 A1 Jun. 30, 2005

(30) Foreign Application Priority Data

Dec. 26, 2003 (JP) ..... 2003-432726

(51) Int. Cl.
*G03G 15/01* (2006.01)

(52) U.S. Cl. ..... 399/149

(58) Field of Classification Search ..... None
See application file for complete search history.

(56) References Cited

U.S. PATENT DOCUMENTS

| | | | | |
|---|---|---|---|---|
| 6,701,116 | B1 | 3/2004 | Aoki | 398/298 |
| 6,970,670 | B1 * | 11/2005 | Konishi et al. | 399/167 |
| 2005/0100364 | A1 * | 5/2005 | Nishimura | 399/149 |

FOREIGN PATENT DOCUMENTS

| | | |
|---|---|---|
| JP | 05-002289 | 1/1993 |
| JP | 09-325607 | 12/1997 |
| JP | 2001-255744 | 9/2001 |
| JP | 2001-337503 | 12/2001 |
| JP | 2002-108030 | 4/2002 |
| JP | 2002-229344 | 8/2002 |
| JP | 2002-251050 | 9/2002 |
| JP | 2002-258547 | 9/2002 |
| JP | 2002-258567 | 9/2002 |
| JP | 2002-268322 | 9/2002 |
| JP | 2002-328504 | 11/2002 |
| JP | 2003-084489 | 3/2003 |
| JP | 2003-270900 | 9/2003 |

* cited by examiner

*Primary Examiner*—Quana Grainger
(74) *Attorney, Agent, or Firm*—Roylance, Abrams, Berdo & Goodman, L.L.P.

(57) ABSTRACT

An image forming apparatus, including toner image agitating units installed between transfer locations and charging locations of a plurality of image forming portions disposed on a transfer carrier belt, reducing adhesion of residual toner to photosensitive conductors. Toner agitating intensities by the toner image agitating units increase in a direction in which the transfer carrier belt transfers paper. Accordingly, a degradation of the quality of an image due to the residual toner is substantially prevented, leading to an improvement in the printing quality. Also, due to adequate distribution of loads upon the photosensitive conductors, the manufacturing costs and life spans of the photosensitive conductors may be reasonably controlled while keeping a high quality image.

20 Claims, 1 Drawing Sheet

IMAGE FORMING APPARATUS REDUCING ADHESION OF RESIDUAL TONER TO A PHOTOSENSITIVE CONDUCTOR

CROSS REFERENCE TO RELATED APPLICATION

This application claims the benefit under 35 U.S.C. § 119(a) of Japanese Patent Application No. 2003-432726, filed on Dec. 26, 2003, in the Japanese Intellectual Property Office, the entire disclosure of which is hereby incorporated by reference.

BACKGROUND OF THE INVENTION

1. Field of the Invention

The present invention relates to an image forming apparatus. More particularly, the present invention relates to a tandem type image forming apparatus that forms a toner image using electrophotography.

2. Description of the Related Art

Tandem type image forming apparatuses capable of improving a printing speed have been used as multi-color image forming apparatuses, such as, color printers, color copiers, color facsimiles, and the like. In tandem type image forming apparatuses, a plurality of image forming portions are disposed on a transfer carrier belt or an intermediate transfer belt so that toner images corresponding to images of separated colors are sequentially transferred onto transfer paper absorbed by the transfer carrier belt or directly onto the intermediate transfer belt and overlapped thereon, thereby forming a multi-color toner image.

Since tandem type image forming apparatuses include a plurality of image forming portions as described above, a minimization of each of the image forming portions is strongly required to reduce sizes of the apparatuses. Thus, cleanerless systems having no cleaning means for removing transferred toner remaining on a photosensitive conductor have been proposed.

For example, Japanese Patent Publication No. 2001-337503 (refer to pages 4 through 7 and FIG. 1 thereof) discloses a cleanerless type color image forming apparatus that sequentially transfers yellow, cyan, magenta, and black colors onto an intermediate transfer belt. The color image forming apparatus includes a brush that agitates residual toner attached onto photoconductive drums to weaken adhesion of the residual toner to the photoconductive drums.

Japanese Patent Publication No. hei 5-2289 (refer to page 2 and FIGS. 1 and 4 thereof) discloses a tandem type image forming method adopting such a cleanerless system, in which a predetermined voltage is applied to a transfer device after a typical image forming process or a jam removal operation and toner accumulated in a memory removal member is returned to an image carrier.

However, the above-described conventional image forming apparatuses have several problems. One problem in the image forming apparatus disclosed in Japanese Patent Publication No. 2001-337503 is that the adhesion of the toner is weakened by the brush for collecting toner. Additionally, toner agitation intensity higher than mono-color image forming apparatuses is required because of the large generation of residual toner. Hence, a greater burden is imposed upon the photoconductive drums than in the mono-color image forming apparatuses. Particularly, a life span of a photoconductive drum that forms a black toner image is shortened because it is frequently used.

Another problem exists when the image forming method disclosed in Japanese Patent Publication No. hei 5-2289 is applied to tandem type image forming apparatuses. A higher voltage is applied to the memory removal member located at a lower course of a toner stream, which accumulates reversely transferred toner, than to an upper course of the toner stream to return residual toner to the image carrier. Alternatively, the residual toner may be returned to the image carrier by applying a predetermined voltage for a longer period of time to the memory removal member than to the upper course of the toner stream. In other words, compared with a mono-color control case, a high-voltage disclosure condition is strict, the amount of charge products attached to the image carrier increases, or the reliability of an internal pressure of the image carrier is degraded. The charge products are produced due to discharge from the transfer device. Consequently, the quality of an image is degraded, and the durability of the image carrier becomes shorter.

SUMMARY OF THE INVENTION

The present invention provides a cost-efficient and durable image forming apparatus using a cleanerless system in which loads are reasonably distributed to photosensitive conductors to maintain a high image quality.

According to an aspect of the present invention, there is provided an image forming apparatus in which charging units, exposing units, and developing units are disposed around photosensitive conductors to form toner images on the photosensitive conductors, and a plurality of image forming portions are disposed on a transfer carrier belt to sequentially overlap and transfer the toner images and form an image. The image forming apparatus includes a toner image agitating units that are installed between transfer locations and charging locations of the image forming portions to reduce adhesion of residual toner to the photosensitive conductors. Toner agitating intensities by the toner image agitating units increase in a direction where the transfer carrier belt transfers paper.

The toner image agitating units may have shapes of brushes that contact the photosensitive conductors. The toner agitating intensities may vary depending on shape characteristics of the brush-shaped toner image agitating units.

The toner image agitating units may have shapes of rollers that contact the photosensitive conductors. The toner agitating intensities may vary depending on distances between axes of the roller-shaped toner image agitating units and axes of the photosensitive conductors.

The toner image agitating units may have shapes of rollers that rotate and slide at predetermined linear velocity ratios with respect to the photosensitive conductors. The toner agitating intensities may vary depending on the linear velocity ratios.

The toner image agitating units may be conductive units that contact the photosensitive conductors and receive bias voltages. The toner agitating intensities may vary depending on the bias voltages.

An image forming portion of the plurality of image forming portions existing in front in the direction where the transfer carrier belt transfers the paper forms a black toner image.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1:
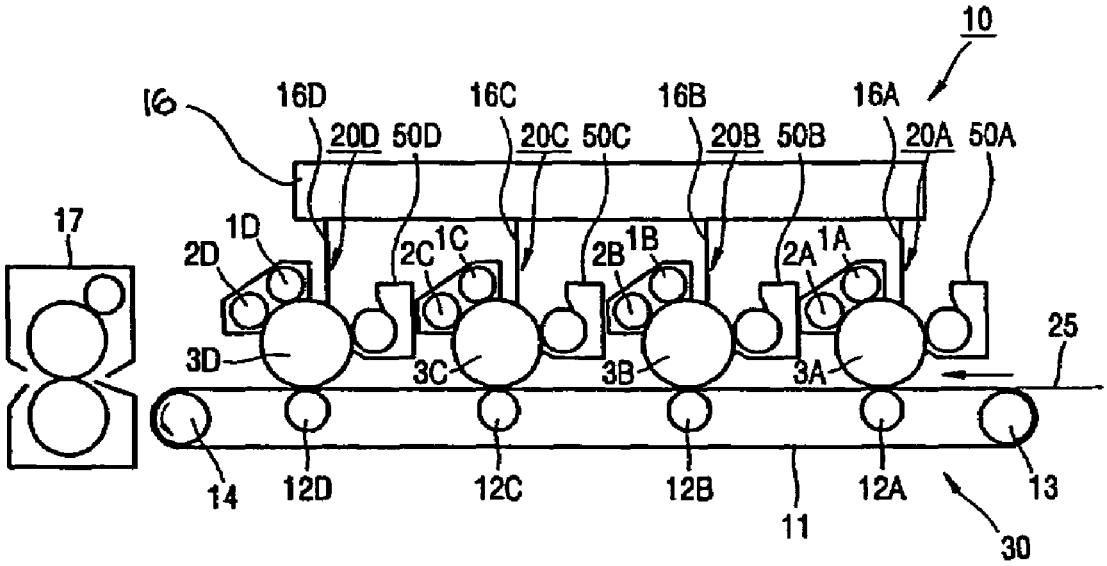
FIG. 1 is a cross-sectional view schematically illustrating a major part of an image forming apparatus according to an exemplary embodiment of the present invention.

In an image forming apparatus according to the present invention, a charging unit, an exposing unit, and a developing unit are disposed around each photosensitive conductor to form toner images on the photosensitive conductors. A plurality of image forming portions adapted to transfer the toner images at transfer positions are disposed on a transfer carrier belt. The toner images are sequentially overlapped and transferred onto a transfer paper, thereby forming an image on the transfer carrier belt. In one embodiment of an image forming apparatus, toner image agitating units to reduce adhesion of residual toner to the photosensitive conductors are installed between transfer locations and charging locations of the image forming portions. Toner agitation intensities by the toner image agitating units increase in a direction where the transfer carrier belt transfers paper.

In the image forming apparatus according to an embodiment of the present invention, since the toner agitation intensities by the toner image agitating units increase in the direction where the transfer carrier belt transfers paper, residual toner may be securely agitated although it is increased due to a re-transfer phenomenon in which completely transferred toner returns back to the photosensitive conductors due to an increase of toner image overlapping in the direction where the transfer carrier belt transfers paper.

As a result, it is possible to reduce a toner agitation intensity for a photosensitive conductor located in front in the direction where the transfer carrier belt transfers paper, leading to a reduction of a load upon the photosensitive conductor. Consequently, loads upon the photosensitive conductors may be reasonably distributed. For example, the cost for the entire photosensitive conductors may be reduced by using lowly durable photosensitive conductors as photosensitive conductors located in front in the direction where the transfer carrier belt transfers paper. In addition, durabilities of the image forming portions may be balanced therebetween by disposing image forming portions having frequently printed toner images in front as possible in the direction where the transfer carrier belt transfers paper.

The toner image agitating units have shapes of brushes that contact the photosensitive conductors. The toner agitation intensities formed by the toner image agitating units vary depending on the shape characteristics of the brush-shaped toner image agitating units.

Since the toner image agitating units have shapes of brushes in contact with the photosensitive conductors as described above, the adhesion of toner to the photosensitive conductors may be mechanically reduced. Also, since the toner agitation intensities vary depending on the shape characteristics of the brush-shaped toner image agitating units as described above, the toner agitation intensities may be easily changed by only changing the brush characteristics of the toner image agitating units.

The shape characteristics of the brush-shaped toner image agitating units include a density of hairs implanted on each of the brush-shaped toner image agitating units, a thickness of a brush hair, a length thereof, and the like. The brush-shaped toner image agitating units may have shapes of flat writing brushes or rollers.

The toner image agitating units may have shapes of rollers that contact the photosensitive conductors. The toner agitation intensities generated by the toner image agitating units vary depending on distances between axes of the roller-shaped toner image agitating units and axes of the photosensitive conductors.

Since the toner image agitating units have the shapes of the rollers in contact with the photosensitive conductors as described above, the adhesion of the toner to the photosensitive conductors may be mechanically reduced. Also, since the toner agitation intensities vary depending on the distances between the axes of the roller-shaped toner image agitating units and axes of the photosensitive conductors, the toner agitation intensities may be easily changed just by varying the distances between the axes of the roller-shaped toner image agitating units and the axes of the photosensitive conductors while using a single structure common to the roller-shaped toner image agitating units. Thus, the structures of the roller-shaped toner image agitating units may be unified.

In addition, the roller-shaped toner image agitating units may be rotated at appropriate linear velocity ratios with respect to the photosensitive conductors.

The toner image agitating units may have shapes of rollers that rotate and slide at predetermined linear velocity ratios with respect to the photosensitive conductors. The toner agitation intensities generated by the toner image agitating units vary depending on the linear velocity ratios.

Since the toner image agitating units are the rollers that rotate and slide at the predetermined linear velocity ratios with respect to the photosensitive conductors as described above, the adhesion of the toner to the photosensitive conductors may be mechanically reduced. Also, since the toner agitation intensities vary depending on the linear velocity ratios with respect to the photosensitive conductors as described above, the toner agitation intensities may be easily changed by only varying the linear velocity ratios while using a single structure common to the roller-shaped toner image agitating units. Thus, the structures of the roller-shaped toner image agitating units may be unified.

The toner image agitating units may be conductive units that contact the photosensitive conductors and also receive bias voltages. The toner agitation intensities generated by the toner image agitating units vary depending on the bias voltages.

Since the toner image agitating units are the conductive units that contact the photosensitive conductors and also receive bias voltages as described above, the adhesion of the toner to the photosensitive conductors may be mechanically and electrically reduced. Also, since the toner agitation intensities vary depending on the bias voltages as described above, the toner agitation intensities may be easily changed by only varying the bias voltages while using a single structure common to the conductive toner image agitating units. Thus, the structures of the conductive toner image agitating units may be unified.

In the image forming apparatus according to an embodiment of the present invention, an image forming portion disposed in front in the direction where the transfer carrier belt transfers paper forms a black toner image.

Since an image forming portion that forms a block toner image is disposed in front in the direction where the transfer carrier belt transfers paper, a minimum toner agitating intensity is applied to a photosensitive conductor corresponding to the back image forming portion. Hence, a load upon the photosensitive conductor is minimum. Consequently, even upon black-white printing, damage to the photosensitive conductors is reduced, thereby increasing the durabilities of the photosensitive conductors.

In addition, since the image forming portions disposed over the transfer carrier belt may have adequately distributed toner agitating intensities, loads upon the photosensitive conductors may be adequately controlled in accordance with the toner agitating intensities that depend on the amount of residual toner. Hence, while preventing a degradation of the quality of an image due to residual toner, the manufacturing costs for the image forming apparatus may be reduced, and the life span of the image forming apparatus may be increased.

An image forming apparatus according to an exemplary embodiment of the present invention will now be described with reference to the accompanying drawings.

Figure 2:
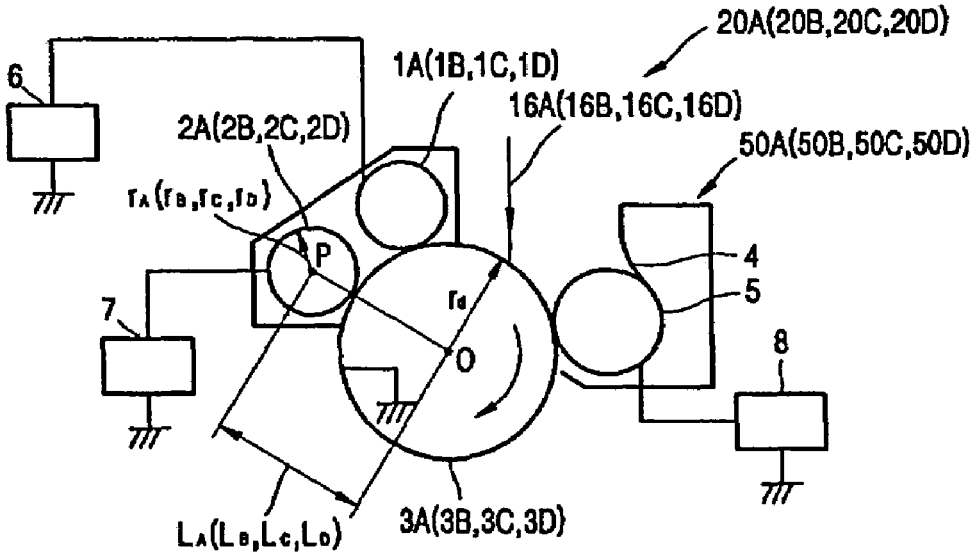
FIG. 2 is a cross-sectional view schematically illustrating an image forming portion of the image forming apparatus of FIG. 1.

FIG. 1 is a cross-sectional view schematically illustrating a major part of a color printer 10, which is the image forming apparatus according to an exemplary embodiment of the present invention. FIG. 2 is a cross-sectional view schematically illustrating image forming portions of the color printer 10.

Referring to FIGS. 1 and 2, the color printer 10 is a tandem type color image forming apparatus that forms an image by separating a color of a to-be-printed image into yellow, magenta, cyan, and black colors, developing the separated color images into toner images using electrophotography, and finally overlapping and transferring the colors of the toner images onto transfer paper 25. The color printer 10 uses a cleanerless system that may collect toner remaining on a photosensitive conductor without installing a toner removal unit, such as, a cleaning blade or the like.

The color printer 10 includes an exposing portion 16, image forming portions 20A, 20B, 20C, and 20D, a transfer carrier portion 30, and a fixing portion 17.

Hereinafter, fully enumerated consecutive reference numerals, for example, the image forming portions 20A, 20B, 20C, and 20D, may be mentioned in a shortened form, for example, the image forming portions 20A through 20D.

The exposing portion 16 scans an outer circumference of a photoconductive drum 3A with light corresponding to image information according to a computer signal so that a latent image may be formed on the outer circumference of the photoconductive drum 3A. The exposing portion 16 may be an instrument that forms a laser beam by modulating a semiconductor laser according to an image signal and deflects and scans the laser beam, a light emitting diode (LED) array device, or the like. The exposing portion 16 is disposed so that light beams 16A, 16B, 16C, and 16D of four colors separated according to an image signal by the exposing portion 16 are applied to parallel scan lines.

As shown in FIG. 2, the image forming portion 20A includes a photoconductive drum 3A (which is a photosensitive conductor) having a photoconductive layer on a surface of a cylindrical metal member having a radius rd. The photoconductive drum 3A has an effective image-forming area equal to or wider than the transfer paper 25 and is rotated in a predetermined direction by a driving unit (not shown). The cylindrical metal member is grounded.

A toner agitating roller 2A (which is a toner image agitating unit), a charging roller 1A (which is a charging unit), an incidence portion of the light beam 16*a*, and a developing unit 50A extend within the range of the effective image-forming area and are sequentially disposed on an outer circumference of the photoconductive drum 3A in a rotating direction indicated by an arrow drawn within the photoconductive drum 3A. A transfer location where a toner image is transferred exists between an upper course in which the toner agitating roller 2A rotates and a lower course in which the developing unit 50A rotates. In other words, the developing unit 50A, the transfer location, and the toner agitating roller 2A are sequentially disposed in a direction where the outer circumference of the photoconductive drum 3A rotates.

The toner agitating roller 2A is installed on an upper side of the photoconductive drum 3A and mechanically and electrically agitates transferred toner remaining on the outer circumference of the photoconductive drum 3A to move the remaining transferred toner to the upper side of the photoconductive drum 3A or to weaken the adhesion of the toner to the photoconductive drum 3A. In the present embodiment, a brush-shaped roller having conductive fiber, such as, nylon, acryl, or the like, implanted as brush hair is used as the toner agitating roller 2A. The toner agitating roller 2A is installed to be rotated at an appropriate linear velocity ratio with respect to the photoconductive drum 3A by a driving unit (not shown) and designed to receive a bias voltage $V_{bA}$ from a high-voltage supply 7. The toner agitating roller 2A has a radius of $r_A$.

The charging roller 1A may be a conductive rubber roller for initially charging the photoconductive drum 3A with a predetermined potential. The charging roller 1A is connected to a high-voltage source 6 to receive a roller voltage Vr from the high-voltage source 6 and charges a surface potential of the photoconductive drum 3A with a predetermined potential $V_D$. In the present embodiment, Vr is −1200V, and VD is −700V.

The developing unit 50A supplies toner to a latent image formed on the outer circumference of the photoconductive drum 3A by the light beam 16A and develops the latent image with toner. The developing unit 50A may be any developing unit as long as it is adapted to collect residual toner that reaches a developing location. For example, a one-component or two-component developing method, in which a developing roller develops toner in contact with a photosensitive conductor, may be used as the developing unit 50A. Hence, the developing unit 50A may be a unit that renders a thin layer of toner (not shown) on the developing roller 5 using a toner layer control blade 4, while simultaneously charging the toner (not shown) with a predetermined potential and attaching the thin toner layer on the developing roller 5 to the photoconductive drum 3A by applying a developing bias voltage VB from a high-voltage source 8 to the developing roller 5. In the present embodiment, VB is −500V.

Each of the image forming portions 20B through 20D has the same structure as that of the above-described image forming portion 20A. For example, the image forming portions 20B, 20C, and 20D include photoconductive drums 3B, 3C, and 3D, respectively, each corresponding to the photoconductive drum 3A; toner agitating rollers 2B, 2C, and 2D, respectively, (with radiuses of $r_B$, $r_C$, and $r_D$, respectively) each corresponding to the toner agitating roller 2A (with a radius of $r_A$); charging rollers 1B, 1C, and 1D, respectively, each corresponding to the charging roller 1A;

and developing units 50B, 50C, and 50D, respectively, each corresponding to the developing unit 50A.

The image forming potions 20A through 20D are disposed so that axes of rotation of the photoconductive drums 3A through 3D are parallel to each other with a predetermined spacing between drums and that transfer locations of the image forming potions 20A through 20D are sequentially arranged on an identical plane. The image forming portion 20A is disposed at the uppermost course in a carrying direction of a transfer carrier portion 30 to be described below. The uppermost course denotes a side where the transfer paper 25 enters when being transferred in the carrying direction.

The developing units 50A through 50D of the image forming portions 20A through 20D are supplied with different color toners. In the present embodiment, the developing units 50A through 50D are supplied with black, cyan, magenta, and yellow toners, respectively. The light beams 16A through 16D of black, cyan, magenta, and yellow colors are separated and modulated according to the image signal and are incident upon the image forming portions 20A through 20D. Toner images having colors of the outer circumferences of the photoconductive drums 3A through 3D may be formed.

The toner agitating intensities of the toner agitating rollers 2A through 2D increase in an arrangement sequence of the image forming portions 20A through 20D.

The toner agitating intensities may vary depending on a factor related to mechanical agitation, such as, the shape characteristics of a brush, including densities of hairs implanted into the toner agitating rollers 2A through 2D, lengths of the brush hairs, and thicknesses thereof. Alternatively, the toner agitating intensities may be changed by adequately adjusting and combining the shape characteristics of the brush.

The toner agitating intensities increase with an increase of the density of the implanted brush hair. For example, the density of the implanted brush hair may vary with a range of 25,000 to 150,000 hairs per square inch. To make toner agitation more efficient and reduce loads upon the photoconductive drums 3A through 3D, the density of the implanted brush hair preferably varies within a range of 50,000 to 100,000 hairs per square inch.

The toner agitating intensities increase with an increase of the thickness of the implanted brush hair. For example, the thickness of the implanted brush hair may vary within a range of 10,000 to 90,000 d. To make the toner agitation more efficient and reduce the loads upon the photoconductive drums 3A through 3D, the thickness of the implanted brush hair preferably varies within a range of 20,000 to 60,000 d. Here, d denotes a unit of a thickness of a thread, and 1*d* is equal to the thickness of a thread having a length of 450 meters and a mass of 0.05 g.

The toner agitating intensities increase with an increase of the length of the implanted brush hair. For example, the length of the implanted brush hair may vary within a range of 0.75 to 4.5 mm. To make toner agitation more efficient and reduce loads upon the photoconductive drums 3A through 3D, the length of the implanted brush hair preferably varies within a range of 1.5 to 3 mm.

The toner agitating intensities may also vary depending on another factor related to mechanical agitation, such as, an amount of pressure contact of the brush with the photoconductive drums 3A through 3D.

The amount of the pressure contact is defined as amounts $\Delta L_A$ through $\Delta L_D$ of overlapping by pressure contact between the toner agitating rollers 2A through 2D and the photoconductive drums 3A through 3D. When distances between rotation axes of the toner agitating rollers 2A through 2D and the photoconductive drums 3A through 3D are LA through $L_D$, the amount of the pressure contacts $\Delta L_A$ through $\Delta L_D$ are calculated using Equations 1 through 4:

[0056] $$\Delta L_A = r_A + r_d - L_A \quad (1)$$

[0057] $$\Delta L_B = r_B + r_d - L_B \quad (2)$$

[0058] $$\Delta L_C = r_C + r_d - L_C \quad (3)$$

[0059] $$\Delta L_D = r_D + r_d - L_D \quad (4)$$

The toner agitating intensities increase with increases of the amount of the pressure contacts $\Delta L_A$ through $\Delta L_D$. For example, the amount of the pressure contacts $\Delta L_A$ through $\Delta L_D$ may vary within a range of 0.1 to 7.5 mm. To make toner agitation more efficient and reduce loads upon the photoconductive drums 3A through 3D, the amount of the pressure contacts $\Delta L_A$ through $\Delta L_D$ preferably vary within a range of 0.2 to 0.5 mm.

In this case, the amount of the pressure contacts $\Delta L_A$ through $\Delta L_D$ may be changed by adequately changing each element expressed in Equations 1 through 4. For example, $r_A$, $r_B$, $r_C$, and $r_D$ are equal and fixed, and the distances between the axes $L_A$ through $L_D$ are changed. Alternatively, the distances between the axes $L_A$ through $L_D$ are equal and fixed, and $r_A$, $r_B$, $r_C$, and $r_D$ are changed.

Particularly, in the former case, each radius of the toner agitating rollers 2A through 2D is substantially the same. When modifying the toner agitating intensities by changing the axial distances, the components may be easily changed since they have substantially identical structures.

Alternatively, the amount of the pressure contact $\Delta L_A$ through $\Delta L_D$ may also be changed by fixing rotating axes of the toner agitating rollers 2A through 2D at predetermined locations. However, the amount of the pressure contact $\Delta L_A$ through $\Delta L_D$ may also be changed by balancing the elastic pressures with which the rotating axes of the toner agitating rollers 2A through 2D are elastically supported to contact the photoconductive drums 3A through 3D with the elastic deformations of the toner agitating rollers 2A through 2D.

The toner agitating intensities may also vary depending on still another factor related to mechanical agitation, such as, the linear velocity ratios of the toner agitating rollers 2A through 2D to the photoconductive drums 3A through 3D.

The toner agitating intensities increase with increases of the linear velocity ratios. The linear velocity ratios may be changed within a range of 1 to 4.5 times. To reduce loads upon the photoconductive drums, the linear velocity ratios are preferably changed within a range of 1 to 3 times. The toner agitating intensities may also vary depending on a factor related to electrical agitation, such as, bias voltages $V_{bA}$ through $V_{bD}$ to be applied to the toner agitating rollers 2A through 2D. Accordingly, the high-voltage source 7 is designed to apply different voltages to the toner agitating rollers 2A through 2D.

The toner agitating intensities increase with decreases of the absolute values of the bias voltages. The bias voltages may vary within a range of −1000 to −500V.

In any of the above-described cases, the toner agitating intensities of the toner agitating rollers 2A through 2D may not be equal to one another. For example, the toner agitating roller 2A has a minimum toner agitating intensity, the toner agitating roller 2D has a maximum toner agitating intensity, and the other toner agitating rollers 2B and 2C have intermediate toner agitating intensities that are approximately equal to each other.

When the toner agitating intensities of the toner agitating rollers 2A through 2D are indicated by $P_A$ through $P_D$, the toner agitating intensities $P_A$ through $P_D$ in the present embodiment are preferably set so that $P_A<P_B<P_C<P_D$. For example, when toner images are agitated by only changing bias voltages, the bias voltages are preferably set so that $|V_{bA}|<|V_{bB}|<|V_{bC}|<|V_{bD}|$.

The toner agitating intensities may be adequately controlled by narrowing differences between the values of each of the toner agitating intensity changing factors, such as, the radiuses $r_A$ through $r_D$, the pressure contact amounts $\Delta L_A$ through $\Delta L_D$, and the bias voltages $V_{bA}$ through $V_{bD}$.

As shown in FIG. 1, the transfer carrier portion 30 comprises a transfer carrier belt 11, which is a thin endless belt formed of a dielectric, such as, synthetic resin, synthetic rubber, or the like. A driving roller 14 is disposed on one side of the transfer carrier belt 11, and a moving roller 13 is disposed on the other side of the transfer carrier belt 11. The transfer carrier portion 30 is supported by the driving roller 14 and the moving roller 13. The driving roller 14 may be rotated in a direction indicated by an arrow by a driving unit (not shown). The transfer carrier portion 30 may be disposed vertically, horizontally, or aslant. The photoconductive drums 3A through 3D contact an outer circumference of the transfer carrier belt 11, and transfer rollers 12A through 12D contact a corresponding inner circumference of the transfer carrier belt 11 such as to face the photoconductive drums 3A through 3D.

The transfer rollers 12A through 12D, which are conductive rubber rollers, are connected to a high-voltage source (not shown), absorb toner images formed on the photoconductive drums 3A through 3D toward the transfer carrier belt 11, and transfer the toner images onto the transfer paper 25 carried by the transfer carrier belt 11.

Hence, a positive high voltage, for example, 2 kV, is applied to the transfer rollers 12A through 12D.

The fixing portion 17 applies heat and pressure to the toner images overlapped and transferred to the transfer paper 25 to fix the toner images to the transfer paper 25. Any well-known fixing unit may be used as the fixing portion 17.

An operation of the color printer 10 is described below based on operations of the toner agitating rollers 2A through 2D.

When the color printer 10 receives an external print signal, image signals separated according to color are applied to the exposing portion 16 and light beams 16*a* through 16*d* modulated according to the image signals are injected into the image forming portions 20A through 20D, which form and develop latent images. At the same time, the transfer paper 25 is carried by the transfer carrier portion 30 and supplied onto the transfer carrier belt 11 on a side where the moving roller 13 is installed. The transfer paper 25 is electrostatically transferred onto the transfer carrier belt 11 and carried in the direction indicated by an arrow. When the transfer paper 25 enters between the image forming portion 20A and the transfer carrier belt 11, the toner image on the photoconductive drum 3A is electrostatically transferred onto the transfer paper 25 by the transfer roller 12A, and the transfer paper 25 is carried at a predetermined linear velocity.

The toner images of the image forming portions 20B, 20C, and 20D are sequentially transferred by the transfer rollers 12B, 12C, and 12D, and four color toner images are sequentially overlapped on the transfer paper 25. The transfer paper 25 is separated from the transfer carrier belt 11 at a side where the driving roller 14 is installed and transferred to the fixing portion 17. The overlapped toner images are then fixed to the transfer paper 25 in the fixing portion 17.

When the color printer 10 receives an external black-and-white print signal, the above-described printing operation is performed by only the image forming portion 20A, thus forming a black-and-white image using black toner. In the color printer 10, the frequency of operations of the image forming portion 20A and the consumption of the toner image of the image forming portion 20A are maximum for several reasons, such as, the fact that a black printing portion is used in many image printings, the fact that black-and-white printing frequently occurs, and the like.

Toner remains on the photoconductive drums 3A through 3D that is not transferred to the transfer paper 25 by the transfer rollers 12A through 12D.

The remaining toner includes transfer residual toner, reversely charged toner, and re-transfer toner. The transfer residual toner denotes negatively charged toner remaining on the photoconductive drums 3A through 3D by not being transferred to the transfer paper 25. The reversely charged toner denotes positively charged toner partially generated in a developing unit. The re-transfer toner denotes toner absorbed to a surface of each of the photosensitive drums 3B through 3D for a color other than the absorbed toner color due to a change in a charged toner amount or a reverse charging due to positive charging by the transfer rollers 12B through 12D. When the image forming portions 20A through 20D have equal transfer efficiencies, the amount of the remaining toner varies depending on the amount of the re-transfer toner. In other words, the re-transfer toner increases in a sequence of the photoconductive drums 2B, 2C, and 2D, which sequentially have more chances to contact completely transferred toners of other colors.

When these residual toners reach the toner agitating rollers 2A through 2D, they are mechanically and electrically agitated with toner agitating intensities. Hence, the agitated residual toners are moved above the photoconductive drums 3A through 3D, or adhesion of the residual toners to the photoconductive drums 3A through 3D is reduced.

For example, due to contact between brush hair of the toner agitating roller 2A and residual toner, the residual toner may be mechanically moved by an elastic force and a rotating force of the brush hair that exceed an adhesion of the residual toner to the photoconductive drum 3A. Once the adhesion of the residual toner is released due to a Van der Waals' force or a Coulomb's force, the adhesion rapidly decreases, and the original adhesion cannot be recovered. In addition, since the brush hair contacts the residual toner with high frequency by rotation of the toner agitating roller 2A, the toner is repetitively moved, and a percentage of toner removed from the surface of the photoconductive drum 3A increases for several reasons, such as, capture of the toner in between brush hairs after being completely detached from the surface of the photoconductive drum 3A.

In other words, toner agitating intensities, such as, the shape characteristics of a brush, the pressure welding amount, and the linear velocity ratio of a roller, are increased in proportion to the elasticity of brush hair, the density of the brush hair, the frequency of contacts between the brush hair and toner, and the like.

The residual toner may be electrically agitated by applying the bias voltage $V_{bA}$ to the toner agitating roller 2A. More specifically, by applying a bias voltage $V_{bA}$ whose absolute value is greater than a dark potential and smaller than a potential on a surface of the photoconductive drum 3A to the toner agitating roller 2A, the toner agitating roller 2A evens the potential on the surface of the photoconductive drum 3A to which the residual toner has been attached and reduces a Coulomb's force applied to the residual toner charged with several charges. Simultaneously, the toner agitating roller 2A contacts the residual toner and controls the charges of the residual toner or absorbs the residual toner. Thus, the residual toner is electrically agitated.

When the residual toner is agitated in this way, positively charged toner is collected by the charging roller 1A, and negatively charged toner passes the charging roller 1A and is re-attached to the photoconductive drum 3A due to an action of a developing bias voltage in a contact developing unit of the developing roller 5. Alternatively, the negatively charged toner is smoothly collected by the developing unit 50A.

If the amount of residual toner interposed between the toner agitating roller 2A and the photoconductive drum 3A is small, the mechanical or electrical toner agitation acts as a load upon the photoconductive drums 2A through 2D and causes a degradation of the quality of an image over time.

In the present embodiment, as the toner agitating intensities increase in a sequence of the toner agitating rollers 2A through 2D, the residual toners may be reasonably agitated depending on the amounts of the residual toner. Accordingly, mechanical and electrical loads upon the photoconductive drum 3A may be reduced, and the life span of the photoconductive drum 3A is increased more than the other photoconductive drums.

Particularly, the image forming portion 20A for forming a black toner image that is prone to be frequently printed or consumed is disposed in front in the direction where the transfer carrier belt 11 transfers paper, such that the amount of re-transfer toner decreases. Also, a load imposed upon the photoconductive drum 3A by the toner agitating roller 2A may be minimized due to a minimization of residual toner remaining on the photoconductive drum 3A. Thus, the image forming apparatus may have a structure providing a balance between life spans of the photoconductive drums 3A through 3D.

As described above, in the tandem type image forming apparatus adopting a cleanerless system, the manufacturing costs and life spans of the photoconductive drums may be adequately controlled while preventing a degradation of the quality of an image due to residual toner.

Although the toner agitating rollers 2A through 2D, which are brush type rollers, are used as toner image agitating units in the present embodiment, flat writing brushes or rollers not mixed with brushes may be used depending on how much toner agitating intensities are desired. An example of the roller not mixed with a brush includes a sponge type roller using an elastic foaming material, such as, sponge.

Alternatively, a roller-shaped or pad-shaped member having apertures between fibres, such as, a non-woven fabric, may be used.

Although the image forming apparatus according to the present embodiment includes a transfer carrier portion, it may include an intermediate transfer belt on which image forming portions are disposed, instead of the transfer carrier portion.

An image forming apparatus according to the present invention has the following effects. First, the quality of printing may be improved by preventing a degradation of the quality of an image due to residual toner.

Second, due to adequate distribution of loads upon the photosensitive conductors, the manufacturing costs and life spans of photosensitive conductors may be reasonably controlled while maintaining a high quality image.

Third, the image forming apparatus may be compactly made by not installing cleaning units around the photoconductive drums.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An image forming apparatus in which charging units, exposing units, and developing units are disposed around photosensitive conductors to form toner images on the photosensitive conductors, and a plurality of image forming portions are disposed on a transfer carrier belt to sequentially overlap and transfer the toner images and form an image, the image forming apparatus, comprising:

a toner image agitating unit installed between the transfer location and the charging location of each of the image forming portions to reduce adhesion of residual toner to the photosensitive conductors, wherein toner agitating intensities by the toner image agitating units increase in a direction in which the transfer carrier belt transfers paper.

2. The image forming apparatus of claim 1, wherein the toner image agitating units that contact the photosensitive conductors are brush-shaped, and the toner agitating intensities vary depending on shape characteristics of the brush-shaped toner image agitating units.

3. The image forming apparatus of claim 1, wherein the toner image agitating units that contact the photosensitive conductors are roller-shaped, and the toner agitating intensities vary depending on distances between axes of the roller-shaped toner image agitating units and axes of the photosensitive conductors.

4. The image forming apparatus of claim 2, wherein the toner image agitating units that contact the photosensitive conductors are roller-shaped, and the toner agitating intensities vary depending on the distances between the axes of the roller-shaped toner image agitating units and the axes of the photosensitive conductors.

5. The image forming apparatus of claim 1, wherein the toner image agitating units are roller-shaped and rotate and slide at predetermined linear velocity ratios with respect to the photosensitive conductors, and the toner agitating intensities vary depending on the linear velocity ratios.

6. The image forming apparatus of claim 2, wherein the toner image agitating units are roller-shaped and rotate and slide at the predetermined linear velocity ratios with respect to the photosensitive conductors, and the toner agitating intensities vary depending on the linear velocity ratios.

7. The image forming apparatus of claim 3, wherein the toner image agitating units are roller-shaped and rotate and slide at the predetermined linear velocity ratios with respect to the photosensitive conductors, and the toner agitating intensities vary depending on the linear velocity ratios.

8. The image forming apparatus of claim 4, wherein the toner image agitating units are roller-shaped and rotate and slide at the predetermined linear velocity ratios with respect to the photosensitive conductors, and the toner agitating intensities vary depending on the linear velocity ratios.

9. The image forming apparatus of claim 1, wherein the toner image agitating units are conductive units that contact the photosensitive conductors and receive bias voltages, and the toner agitating intensities vary depending on the bias voltages.

10. The image forming apparatus of claim 2, wherein the toner image agitating units are conductive units that contact the photosensitive conductors and receive the bias voltages, and the toner agitating intensities vary depending on the bias voltages.

11. The image forming apparatus of claim 3, wherein the toner image agitating units are conductive units that contact the photosensitive conductors and receive the bias voltages, and the toner agitating intensities vary depending on the bias voltages.

12. The image forming apparatus of claim 4, wherein the toner image agitating units are conductive units that contact the photosensitive conductors and receive the bias voltages, and the toner agitating intensities vary depending on the bias voltages.

13. The image forming apparatus of claim 5, wherein the toner image agitating units are conductive units that contact the photosensitive conductors and receive the bias voltages, and the toner agitating intensities vary depending on the bias voltages.

14. The image forming apparatus of claim 6, wherein the toner image agitating units are conductive units that contact the photosensitive conductors and receive the bias voltages, and the toner agitating intensities vary depending on the bias voltages.

15. The image forming apparatus of claim 1, wherein an image forming portion of a plurality of image forming portions is disposed in front in the direction in which the transfer carrier belt transfers the paper and forms a black toner image.

16. The image forming apparatus of claim 2, wherein an image forming portion of a plurality of image forming portions is disposed in front in the direction in which the transfer carrier belt transfers the paper and forms a black toner image.

17. The image forming apparatus of claim 3, wherein an image forming portion of a plurality of image forming portions is disposed in front in the direction in which the transfer carrier belt transfers the paper and forms a black toner image.

18. The image forming apparatus of claim 4, wherein an image forming portion of a plurality of image forming portions is disposed in front in the direction in which the transfer carrier belt transfers the paper and forms a black toner image.

19. The image forming apparatus of claim 5, wherein an image forming portion of a plurality of image forming portions is disposed in front in the direction in which the transfer carrier belt transfers the paper and forms a black toner image.

20. The image forming apparatus of claim 6, wherein an image forming portion of a plurality of image forming portions is disposed in front in the direction in which the transfer carrier belt transfers the paper and forms a black toner image.

* * * * *